United States Patent [19]

Lipschutz

[11] 4,099,398

[45] Jul. 11, 1978

[54] LOCK KEY, METHOD FOR ITS MANUFACTURE AND LOCK EMPLOYING THIS KEY

[75] Inventor: Paul Lipschutz, Croissy-sur-Seine, France

[73] Assignee: Societe Neiman SA, Courbevoie, France

[21] Appl. No.: 780,934

[22] Filed: Mar. 24, 1977

Related U.S. Application Data

[63] Continuation-in-part of Ser. No. 561,146, Mar. 24, 1975, abandoned.

[30] Foreign Application Priority Data

Apr. 18, 1974 [FR] France ..... 74 13585

[51] Int. Cl.[2] ..... E05B 19/04

[52] U.S. Cl. ..... 70/406; 70/408

[58] Field of Search ..... 70/393, 401, 402, 405, 70/406, 407, 408, 409

[56] References Cited

U.S. PATENT DOCUMENTS

| | | | |
|---|---|---|---|
| 2,690,070 | 9/1954 | Spain | 70/421 |
| 3,478,549 | 11/1969 | Schlage | 70/408 |
| 3,754,422 | 8/1973 | Stackhouse | 70/407 |

*Primary Examiner*—Robert L. Wolfe
*Attorney, Agent, or Firm*—Nolte and Nolte

[57] ABSTRACT

A key of which the longitudinally extending grooves which code the key for insertion into the key receiving passage of a lock, extend both through the stem of the key which is inserted into the passage, and through the manipulating head part of the key so that the key blank can be produced by a stamping or pressing operation. There is also described a method of making the key.

9 Claims, 6 Drawing Figures

LOCK KEY, METHOD FOR ITS MANUFACTURE AND LOCK EMPLOYING THIS KEY

REFERENCE TO RELATED APPLICATIONS

This application is a continuation-in-part of application Ser. No. 561,146 filed Mar. 24, 1975 and now abandoned which will become abandoned simultaneously with the filing of this application.

BACKGROUND OF THE INVENTION

The desire to lower costs and lighten, in the automobile equipment field, applies to all parts of this equipment.

This is in particular the case in the field of automobile locking means (switches, anti-theft devices, key operated caps, doors and bonnets).

Consequently, an object of the present invention is to provide a key which is both lighter, stronger and cheaper in respect of material and labor.

It is known that automobile lock keys have, as many other keys, a head facilitating the taking hold of and the actuation of the key (engagement, rotation, disengagement), which head follows on a peen or flat stem one or both edges of which stem are notched, the depth and the spacing between the notches varying from one key to the other so as to constitute a minimum protection against unauthorized opening of the lock.

These conventional keys are produced by blanking from a steel strip followed by a stamping of the head, a milling of grooves in the two faces parallel to the axis of the key whose characteristics differentiate the key entries of the lock. Thereafter, the teeth are produced by milling or cutting to variable depths. Keys exist whose stem profile is produced by stamping, the head of the key remaining flat. This system presents a difficult problem as concerns the connection of the flat part to the stamped part. The flat part does not resist the torque and such a key is much less attractive than a conventional key.

Moreover, in the case of a conventional key whose profile is produced by milling (costly operation) this key has a much lower strength than in the case where this profile is produced by stamping owing to the fact that the stamping surface hardens the material and does not destroy the fibers of the latter.

BRIEF SUMMARY OF THE INVENTION

In order to overcome the mentioned drawbacks of known keys, an object of the invention is to provide a key of the type comprising an active part or stem adapted to be introduced in a lock, and a holding head, said head and said stem being in one piece, wherein the key comprises two distinct substantially planar regions each extending in the head and stem, said regions being interconnected by at least one other surface. The invention also includes the method of producing such a key.

In one embodiment, the planes of said regions are secant. In a modification, they are parallel.

Other objects of the invention are to provide a method for manufacturing the aforementioned key and a lock for using these keys.

DESCRIPTION OF THE FIGURES OF THE DRAWINGS

The invention will be better understood from the ensuring description with reference to the accompanying drawings, in which.

DESCRIPTION OF THE PREFERRED EMBODIMENTS OF THE INVENTION

Figure 1:
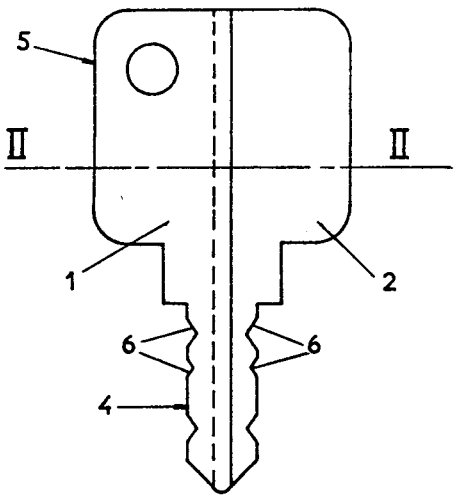
FIG. 1 is an elevational view of a key according to a first embodiment of the invention.
Figure 2:
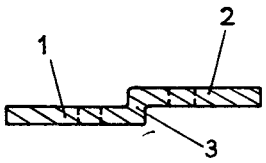
FIG. 2 is a sectional view taken on line II—II of FIG. 1.

With reference first to FIGS. 1 and 2, the key according to the invention is constituted by two planar regions 1 and 2 which are parallel to each other and interconnected by a surface 3 perpendicular to the regions 1 and 2. The planar regions 1 and 2 each extend throughout the length of the stem 4 and the head 5 of the key. The key thus described may be obtained by a single stroke of a press which produces simultaneously the blanking of the key in a metal blank, defining the head and the stem and the folding of the key according to the particular desired shape. If desired, the notches 6 in the key stem may also be obtained in the course of the pass through the press by means of special and interchangeable tools mounted in the main tool.

Figure 3:
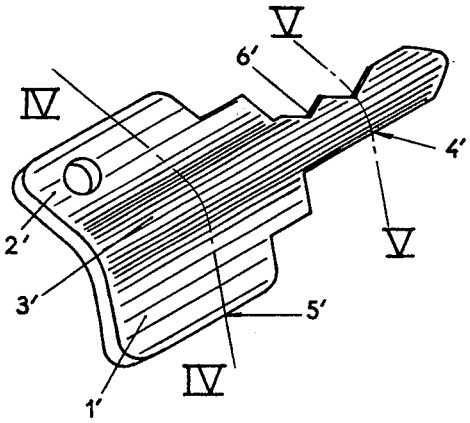
FIG. 3 is a perspective view of a key according to a second embodiment of the invention.
Figure 4:
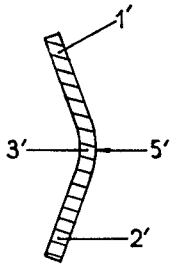
FIG. 4 is a sectional view taken on line IV—IV of FIG. 3.
Figure 5:
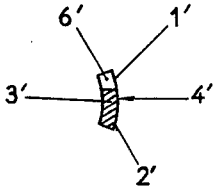
FIG. 5 is a sectional view taken on line V—V of FIG. 3.

In the embodiment shown in FIGS. 3 to 5, the two flat regions 1' and 2' of the key are inclined with respect to each other and the connecting surface 3' is curved. The whole of the key with its head 5' and 4', and optionally with its notches 6', may be produced in the same manner as the previously described key.

The locks according to the invention intended to receive either of the keys just described have a particular construction with an entrance or key receiving slot and an internal distribution according to two distinct planes. In addition to the advantages of lightness and cheapness of the key, the invention permits improving the inviolability of the lock owing to the impossibility of introducing any tool in the lock. The introduction of a flexible strip or false key does not allow a vertical movement of the strip or key in the lock.

Figure 6:
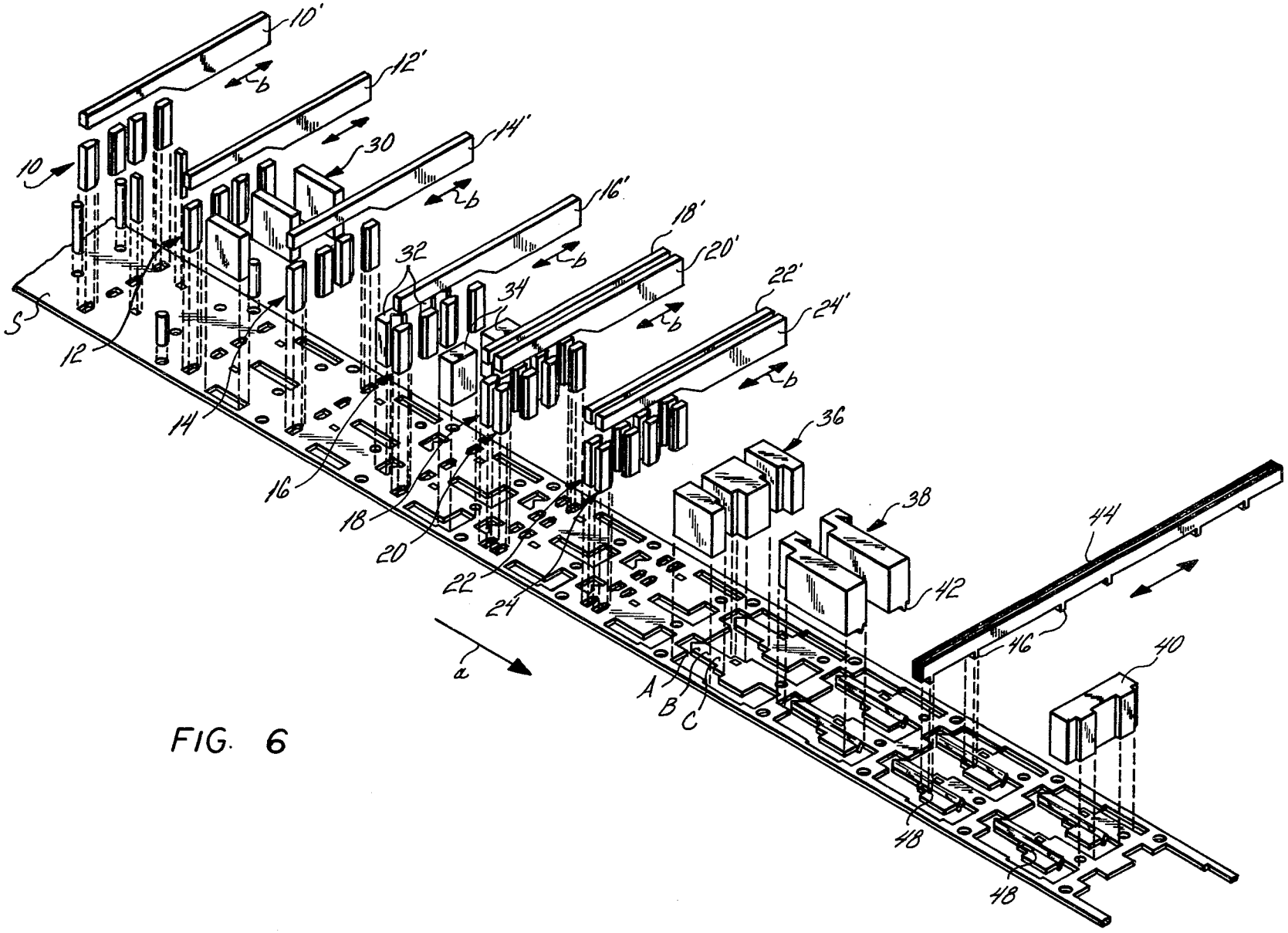
FIG. 6 is a schematic view showing the production of keys according to this invention.

The production technique is illustrated in FIG. 6 and is one which pairs of keys are stamped from a continuous metal strip S, each key having three pairs of opposed notches for cooperation with the tumbler elements of the lock for which the key is intended. The notches may be considered to be at positions A, B and C where A is the nearest to the manipulating head C, is the most remote from the head and B is intermediate A and C and it will be recognized that a notch may be cut at each position or only at one or two of those positions as required to suit the particular lock for which the key is intended.

The strip S is indexed in the direction of arrow *a* beneath a plurality of sets of notch cutting punches 10, 12, 14, 16, 18, 20, 22 and 24, each of which sets has a punch-operating slide 10', 12', etc. associated with it, those slides being reciprocable transversely of the strip as indicated by arrows *b*. The punches 10, 12, 14 and 16 are disposed so that when operated they cut a notch in position A. It will be appreciated that the punches of these sets 12, 14, 16 and 18 are designed to cut notches of different depths and that only one of those punch sets will operated to cut a particular key.

Punch sets 18 and 20 are disposed to cut a notch at location B and again the punches of set 18 are so designed to cut a notch of different depth than punch set 20 and of course only one of those punch sets is operated by an appropriate one of the slides 18', 20' for a given key.

Punch sets 22 and 24 are adapted to cut a notch at position C and again the punches of the sets are adapted to cut a notch of a different depth and only one of slides 22' and 24' is operated to cause a selected punch set to cut. Of course it will be appreciated that as discussed hereabove, depending upon the number of tumbler elements in the particular lock for which the key is intended not all of the punch sets need be operated for each key, i.e. notches need not be cut at each of positions A, B and C.

Punch sets 30, 32, 34 and 36 are effective to cut the outline of the key in the manner indicated in broken line in FIG. 6 while punch 40 severs the key from the strip.

Pressing tools 38 are adapted to code the keys with longitudinal grooves to correspond to the configuration of the key passage of a lock for which the key is intended. It is to be noted that the configurations 42 on the pressing surfaces of elements 38 are such that will press the coding grooves not only along the stem part of the key, but also in the manipulating head.

A plurality of relatively slidable printing elements 44 are provided, the leading faces of the projections 46 of which are provided with indicia, the projections being alignable so that different information relating to the particular notching notching of the key can be impressed upon area 48 of the key, i.e. information identifying the key for replacement purposes.

After the key is separated from the strip the manipulating head part is given a covering of plastic material so that the grooves in that part are not contacted by the user of the key.

What is claimed is:

1. A key comprising a manipulating head part and an integral lock operating part for insertion into a key receiving slot of a lock, an integral connecting part extending the full length of the key and connecting portions of said head part and said operating part on opposite sides thereof, said portions of said head and operating parts on one side of the connecting part lying in a common plane and the portions of said head and operating part on the other side of said connecting part also lying in a common plane, said integral connecting part including a longitudinally extending section disposed in a plane offset from that plane common to said portions of said head and operating parts on said one side of said connecting part, and wherein an edge of at least one of said portion of said operating part most remote from said connecting part is coded by notching and constitutes means cooperating with tumbler elments of a lock when said operating part is inserted into a key receiving slot of a lock.

2. A key comprising a manipulating head part and an integral, operating part for insertion into a key receiving slot of a lock, said head part comprising first and second planar portions disposed on opposite sides of a longitudinally extending, integral connecting part, said operating part also comprising first and second planar portions disposed on opposite sides of a longitudinally extending integral connecting part, the planes of said portions of said head and operating part on one side of said respective connecting portions being coincidental and the planes of portions of said head and operating parts on the other side of said connecting portions being coincidental, said connecting portions of said head part and operating part being longitudinally aligned, an edge of at least one of said first and second portions of said operating part most remote from said longitudinally extending connecting part of said operating part being coded by notching and constituting means cooperating with tumbler elements of a lock when said operating part is inserted in a key receiving slot of a lock, said connecting parts of said head and operating parts including a common, longitudinally extending section disposed in a plane offset from the plane of said first portions of said head and operating parts.

3. Apparatus as claimed in claim 2 wherein the plane in which portions of said head and operating parts on one side of said respective connecting portions lies is parallel to the plane in which said portions on the opposite sides of said connecting portions lies and wherein said connector part comprises a web portion interconnecting adjacent edges of said portions of said head and operating parts.

4. A key as claimed in claim 1 wherein said common planes are parallel and offset from one another and said connecting part comprises a web portion interconnecting adjacent edges of said portions of said head part and said operating part.

5. A key as claimed in claim 2 wherein the plane in which portions of said head and operating parts on one side of said respective connecting portions is disposed, intersects the plane in which said portions of said head and operating parts on the other side of said connecting parts are disposed, a line on which said planes intersect extending longitudinally of the key.

6. A key as claimed in claim 1 wherein said planes intersect one another on a line extending longitudinally of said key.

7. A key as claimed in claim 5 wherein said connecting portions have similar, curved transverse cross-sections.

8. A key as claimed in claim 1 wherein said connecting portion has a substantially constant, curved transverse cross-section.

9. A key as claimed in claim 2 wherein said first and second portions of said head part are disposed in different planes.

* * * * *